United States Patent [19]

Iizuka et al.

[11] 4,102,110

[45] Jul. 25, 1978

[54] COIN PACKAGING SYSTEM

[75] Inventors: Nobuhiro Iizuka; Yoshihiro Hatanaka, both of Himeji, Japan

[73] Assignee: Glory Kogyo Kabushiki Kaisha, Himeji, Japan

[21] Appl. No.: 829,092

[22] Filed: Aug. 30, 1977

[30] Foreign Application Priority Data

Sep. 6, 1976 [JP] Japan ..... 51-106406
Sep. 18, 1976 [JP] Japan ..... 51-112203

[51] Int. Cl.[2] ..... B65B 57/10; B65B 57/20; B65B 11/04

[52] U.S. Cl. ..... 53/59 R; 53/212; 133/1 A; 133/3 A

[58] Field of Search ..... 53/59 R, 212; 133/1 A, 133/3 A, 3 B, 3 C, 3 D, 3 E, 3 F, 3 G, 3 H

[56] References Cited

U.S. PATENT DOCUMENTS

| | | | |
|---|---|---|---|
| 1,893,828 | 1/1933 | Graeme | 133/3 G |
| 4,026,089 | 5/1977 | Murakami | 53/212 X |

*Primary Examiner*—Travis S. McGehee

[57] ABSTRACT

A coin packaging system comprises a coin sorting section for sorting out coins mixedly supplied thereto according to the denominations thereof, a coin packaging section for packaging the sorted coins separately according to the denominations, and a coin denomination selecting section for selecting a denomination of coins to be packaged, the sorted coins being stored in respective sorted coin containing sections. According to one aspect of the invention, the coin packaging section is moved to the sorted coin containing sections selectively in response to the operation of the coin denomination selecting section so as to package the sorted coins separately according to the denominations.

3 Claims, 13 Drawing Figures

FIG. 4
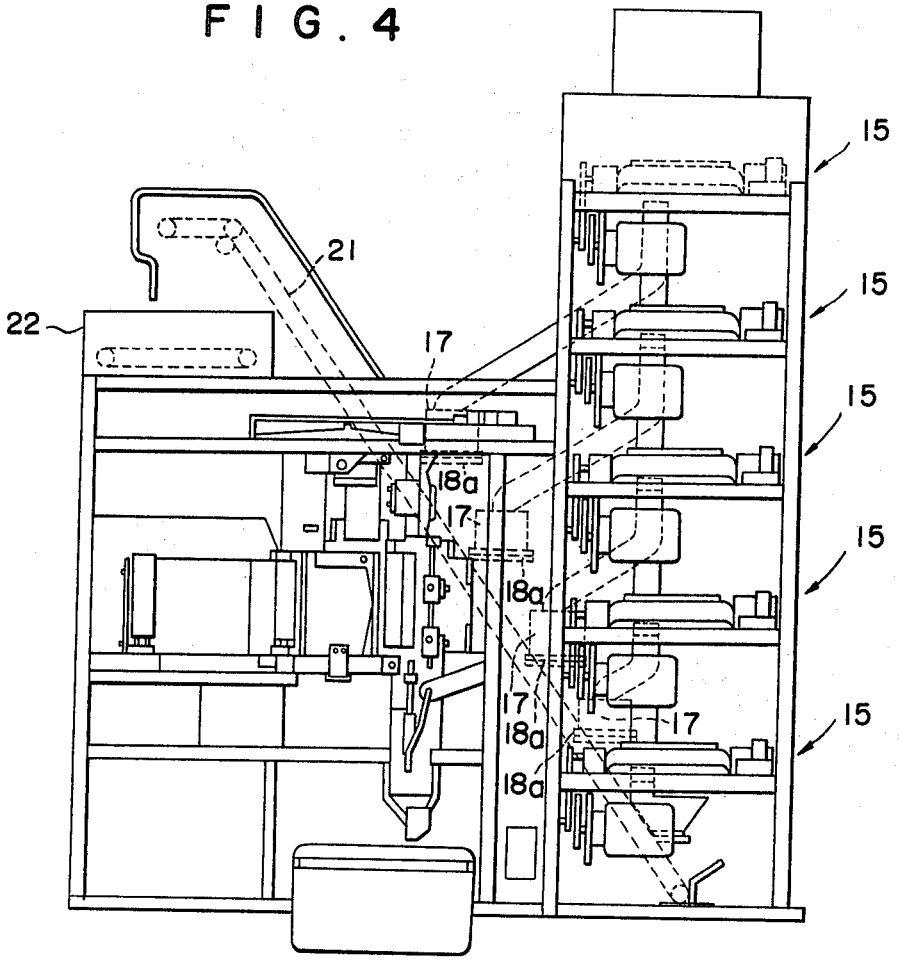
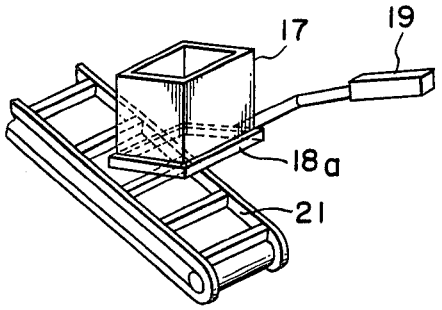
FIG. 6

COIN PACKAGING SYSTEM

BACKGROUND OF THE INVENTION

This invention relates to a coin packaging system in which coins of plural denominations are sorted out and packaged according to the denominations.

A conventional coin packaging machine has no function of sorting out coins of plural denominations. Accordingly, in order that the machine packages coins of a denomination, selected out of coins of plural denominations, it is necessary to use a coin sorting machine, as a preprocess, so that the coins of plural denomination are sorted out according to the denominations. That is, the coin packaging machine needs the coin sorting machine at all times. Accordingly, the conventional coin packaging machine suffers from disadvantages that it is low in efficiency and it takes a relatively long time to package coins as required.

SUMMARY OF THE INVENTION

Accordingly, a primary object of this invention is to provide a coin packaging system in which sorting out coins of plural denominations and packaging sorted coins can be carried out simultaneously whereby its coin processing efficiency is improved.

Another object of the invention is to provide a coin packaging system in which coins sorted out by a coin sorting passageway are contained in respective sorted coin containing sections so as to continuously and effectively carry out coin packaging operations, and means for preventing, when a predetermined number of coins of one and the same denomination to be packaged are supplied to a coin packaging section, further supply of coins is eliminated from the coin sorting passageway (although such means is required for a coin packaging machine in which coins are supplied from a coin sorting section directly to a coin packaging mechanism), whereby its construction is made relatively simple and yet its coin processing efficiency is improved.

Provided according to this invention is a coin packaging system comprising:

(a) a coin sorting section for sorting out coins of plural denominations according to the denominations;

(b) a coin packaging section for packaging coins of a denomination selected out of the coins thus sorted out, for every predetermined number of pieces thereof; and (c) a coin selecting means for selecting a denomination of coins to be packaged out of the coins sorted out by the coin sorting section, so that said coin packaging section operates to package the coins sorted out according to the denominations, on the basis of a denomination selected.

The manner in which the foregoing objects and other objects are achieved by this invention will become more apparent from the following detailed description and the appended claims when read in conjunction with the accompanying drawings.

BRIEF DESCRIPTION OF THE DRAWINGS

In the accompanying drawings:

FIG. 4 is a front view showing a second embodiment of the coin packaging machine according to the invention;

FIG. 6 is a perspective view showing a coin introducing mechanism employed in the second embodiment;

DETAILED DESCRIPTION OF THE INVENTION

Figure 2:
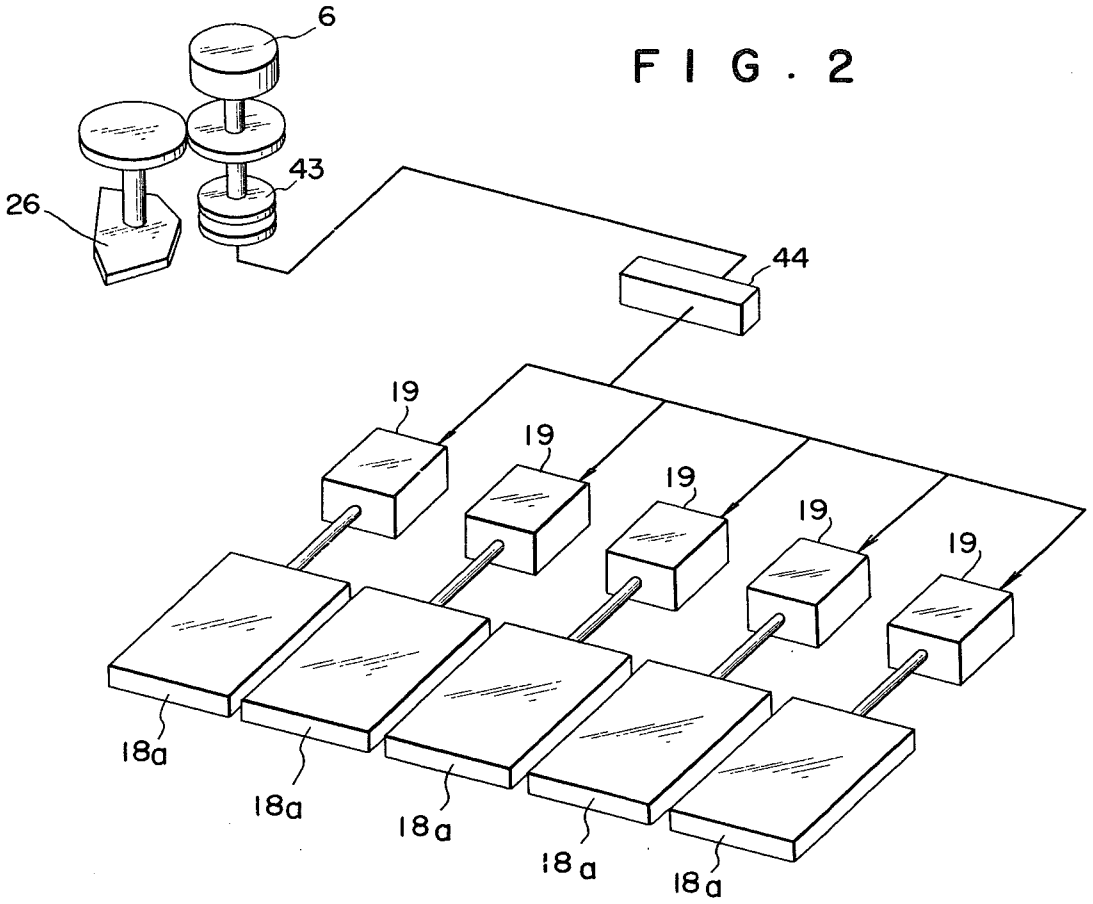
FIG. 2 is also a perspective view showing a coin introducing mechanism employed in the coin packaging machine shown in FIG. 1.
Figure 3A:
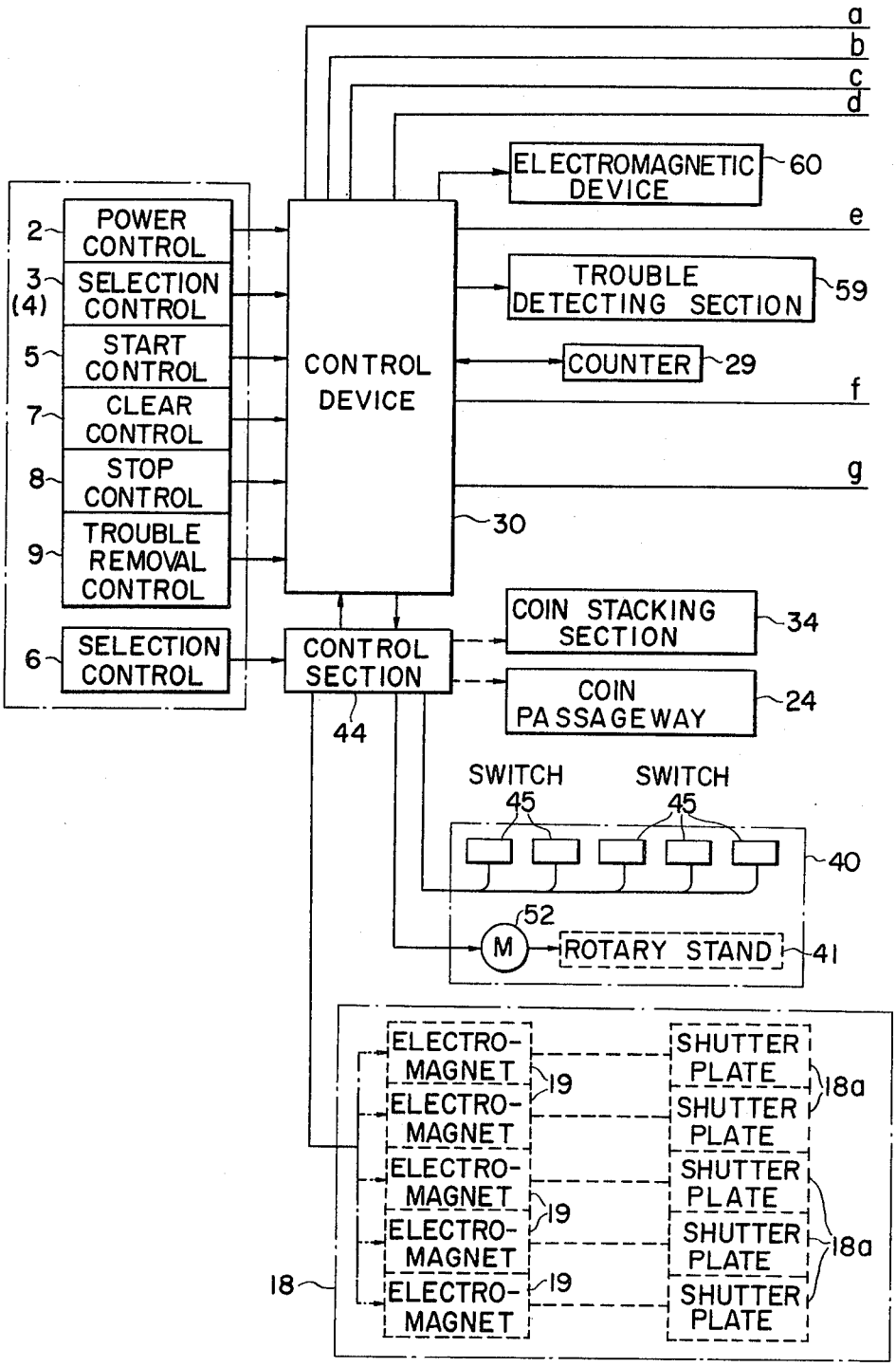
FIGS. 3A and 3B are two parts of a block diagram illustrating an arrangement of the coin packaging machine shown in FIG. 1.
Figure 3B:
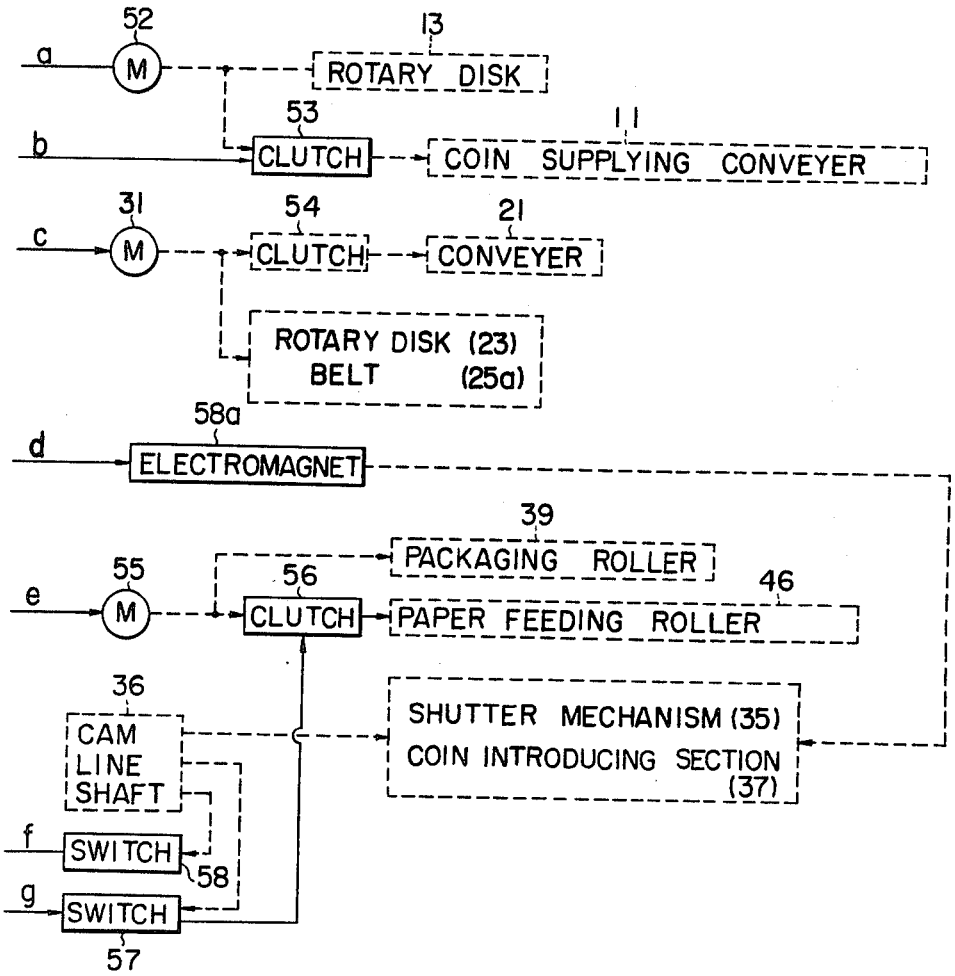

A first embodiment of this invention will be described with reference to FIGS. 1, 2, and 3.

Reference numeral 1 is intended to designate a coin packaging machine body which is provided with an electric source control section 2 for operating switches such as push button type switches and control knobs, a countpackage selection control section 3, a count selection control section 4, a start operating section 5, a coin selection operating section 6 as coin selecting means, clear control section 7, a stop operating section, and a trouble removal control section 9.

The aforementioned body 1 is provided with a hopperlike coin storing section 10, on the bottom of which there is a coin supplying conveyor 11. At the unloading end of the conveyor 11, there is a coin transferring mechanism 12 which comprises a rotary disk 13 for receiving coins supplied by means of the coin supplying conveyor 11. The coins thus supplied are transferred one after another into a coin sorting passageway 14 by a plurality of protrusions (not shown) provided on the rotary disk 13, being aligned along the passageway 14. Accordingly, the coins are moved on along the passageway 14. This passageway 14 has a plurality of coin sorting sections 15 which serve to sort out the coins according to their diameters. At the exit end of each coin sorting section 15 is provided a sorted coin containing section 17.

A coin introducing mechanism 18 selectively operated is provided below the lower openings of the sorted coin containing sections 17. The coin introducing mechanism 18 is made up of shutter plates 18*a* which are provided respectively for the lower openings of the sorted coin containing sections 17 in such a manner that they can reciprocate freely with the aid of respective electromagnets 19 (FIG. 2). A conveyor 21 forming a conveying mechanism 20 is provided below the sorted coin containing sections 17, for transferring coins from the sorted coin containing sections 17 to a sorted coin delivering mechanism 22. This mechanism 22 is made up of a rotary disk 23. Coins fed onto this rotary disk 23 are delivered one by one to a coin passageway 24 by centrifugal force. The coin passageway 24 is defined by two parallel guide members 25 at least one of which is movable. The distance between the two guide members 25 is adjusted according to the diameter of the coins by means of a cam 26 so that coins smaller or larger in diameter are rejected from the coin passageway 24. The aforementioned cam 26 is turned by operating the coin section control section 6 so that the guide member 25 elastically abutted against the cam 26 is moved to define the width of the coin passageway 24 according to the diameter of the coins selected. An endless belt 25*a* is provided above the coin passageway 24 so as to convey the coins fed to the coin passageway 24 along the same 24.

Figure 1:
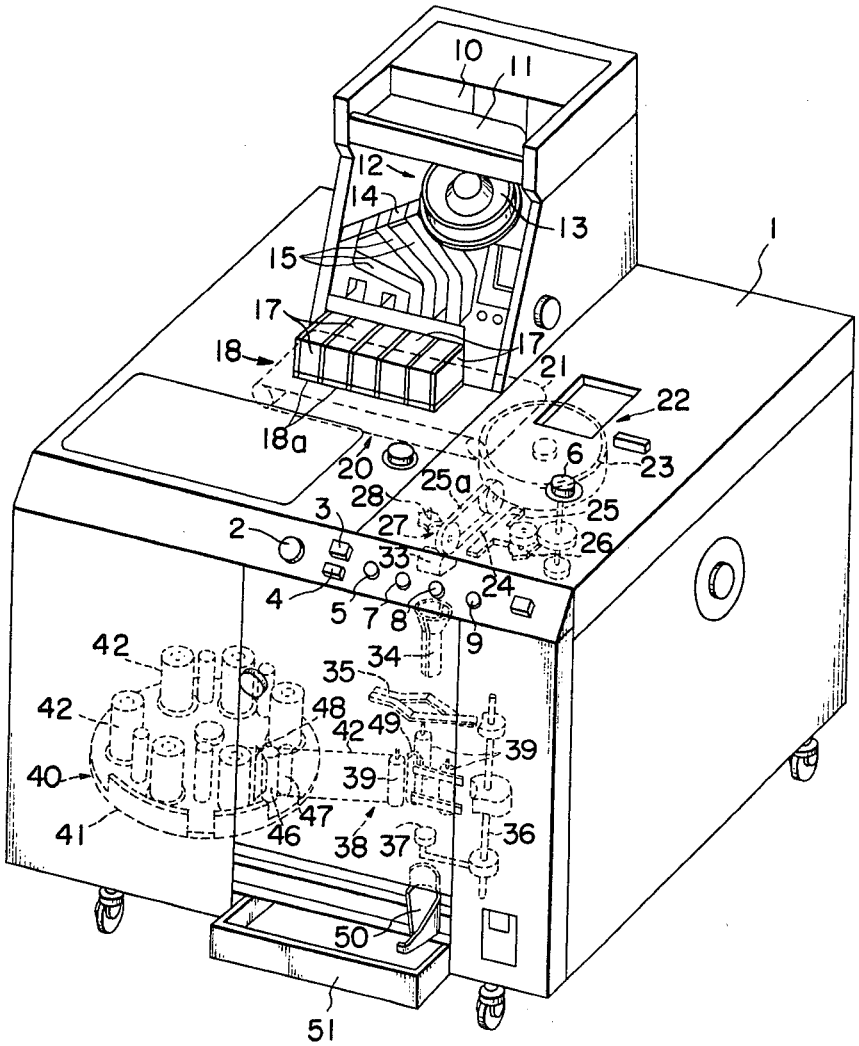
FIG. 1 is a perspective view showing a first embodiment of a coin packaging machine according to this invention.

In FIG. 1, reference numeral 27 is intended to designate a coin counting means made up of a counting wheel 28 which is turned through a predetermined angle whenever a coin passes therethrough. The rotation angle of the counting wheel 28 is mechanically or electrically detected to allow a counter 29 to count the number of coins passed therethrough. When a predetermined number of coins are counted by the counter 29, the counting wheel 28 is stopped to temporarily prevent the flow of coins. A signal representative of the fact that the predetermined number of coins have been counted is applied from the counter 29 to a control device 30, which in turn produces a stop signal to stop an electric motor 30, as a result of which the rotary disk 23 in the sorted coin delivering mechanism 31, and the belt 25*a* of the coin passageway 24 are stopped, while a clutch mechanism 32 is operated to stop the aforementioned conveyor 21.

The counted coins are introduced through a guide path 33 provided at the exit end of the coin passageway 24 into a coin stacking section 34 where they are stacked. The coin stacking section 34 is provided with a stacking cylinder whose diameter is adjusted to the diameter of coins selected by the aforementioned coin selection control section 6 with the aid of a suitable mechanism which is, for instance, a cylinder diameter adjusting cam fixed to a rotary cam operated in association with the shaft of the cam 26. Provided at the lower opening of the coin stacking section 34 is a shutter mechanism 35 which is opened and closed by a cam of a cam line shaft 36.

Reference numeral 37 designates a coin introducing body which is operated by a cam of the cam line shaft 36 so as to introduce the coins stacked, or a stack of coins, in the coin stacking section 34 to a packaging section 38.

This packaging section 38 comprises a plurality of rollers 39 which when the stack of coins is brought to the rollers, operate to sandwich and rotate it. More specifically, at least one of the plurality of rollers 39 is moved by a cam of the cam line shaft 36 so that the stack of coins is sandwiched by the plurality of rollers.

A wrapping paper selecting mechanism 40 comprises a rotary stand 41, and rolls of wrapping paper 42 provided respectively for coins of different denominations (or diameters), the rolls being provided on the rotary stand 41. The rotary stand 41 is turned to a predetermined position by the output of a control section 44 which carries out its control operation with the aid of a rotary switch 43 operated by the aforementioned coin selection control section 6. In other words, a position detecting switch 45 is selectively operated by the output of the control section 44, so that the rotary stand 41 is turned to a feeding position where a wrapping paper 42 is fed for the coins selected. A pair of feeding rollers 46 and 47 are provided on the rotary stand 41 so as to feed the respective wrapping paper 42. A cutter 48 is provided in the vicinity of the feeding rollers 46 and 47. It should be noted that the cutter 48 is fixedly provided on the rotary stand 41 for each roll of wrapping paper (although only one pair of rollers 46 and 47, and only one cutter 48 are shown in FIG. 1).

Reference numerals 49 and 49 are intended to designate crimping hooks for folding both lateral edge portions of the paper 42 wrapped around a stack of coins. These crimping hooks 49 are operated by the aforementioned cam line shaft 36.

A packaged coin receiving section 50 is provided below the packaging section 38. The packaged coin stacks are received by a packaged coin container 51 through the section 50.

The outputs of the aforementioned electric source control section 2, selection control sections 3 and 4, start control section 5, clear control section 7, stop control section 8, and trouble removal control section 9 are applied to the control device 30.

An electromagnetic device 30 is provided for vibrating the coin stacking section 30. This electromagnetic device 60 is operated by the control device 30 when coins are stacked.

The operation of the first embodiment of the invention will be described.

The electric source control section 2 is operated, and the count-package selection control section 3 is operated. Then, the coin selection control section 6 is set for the coins of the largest diameter. As a result, the cam 26 is turned to move the guide member 25, while the coin passage 24 and the coin stacking section 34 are adjusted according to the diameter of the coins. Furthermore, upon operation of the coin selection control section 6, the position detecting switch 45 is selected by the output of the control section 44. At the same time, the motor 52 is driven, and the rotary stand 41 is turned. The rotation of this rotary stand 41 is stopped with the aid of the position detecting switch when the wrapping paper 42 for the coins selected is set at the feeding position.

Under this condition, a number of coins of various denominations are loaded in the coin storing section 10. Then, the start control section 5 is operated. As the motor 52 is driven by the output of the control device 30, the rotary disk 13 is rotated, the clutch 53 is operated, and the coin supplying conveyor 11 is driven by the motor 52, whereby the coins in the coin storing section 10 are supplied onto the rotary disk 13 by the conveyor 11. As the disk 13 rotates, the coins are delivered into the coin sorting passageway 14 one by one by means of the protrusions provided on the rotary disk 13, and are aligned along the coin sorting passageway. The coins thus aligned are sorted out according to the diameters thereof by the coin sorting section 15, and the sorted coins are placed in the respective sorted-coin containing sections 17.

In this operation, the shutter plate 18*a* of a selected one of the sorted coin containing sections 17 is displaced open by the output of the coin selection control section 6 and the output of the start control section 15. Therefore, the sorted coins in that sorted coin containing section 17 are allowed to flow onto the conveyor 21 of the conveying mechanism 20, while the sorted coins of the other denominations are kept stored in the respective sorted coin containing sections 17. In this case, the motor 31 is driven by the output of the start control section 5, the rotary disk 23 and the belt 25*a* are driven, the clutch 54 is operated, and the conveyor 21 is driven by the motor 31. Therefore, the coins are supplied onto the rotary disk 23 from the sorted coin containing section 17. The coins on the disk 23 are transferred one by one onto the coin passageway 24 by centrifugal force and are then delivered out by the belt 25*a*. When each coin passes through the coin passageway 24, the counting wheel 28 is turned through the predetermined angle. After turning the wheel 28, the coins are guided to the coin stacking section 34 and are stacked on the shutter mechanism 35. Upon detection of the predetermined number of coins from the rotation angle of the counting wheel 28, the counter 29 is operated, so that the counting wheel 28 is locked to stop the coin flow, and the motor 31 is stopped, as a result of which the conveyor 21, the rotary disk 23, and the belt 25*a* are stopped. In this connection, if necessary, the motor 52 driving the coin supplying conveyor 11 and the rotary disk 13 may be stopped.

The control device 30 drives the motor 55 with the aid of the output from the counter 29. Therefore, the cam line shaft 36 is driven so as to place the coin introducing body 37 below the shutter mechanism 35, the shutter mechanism 35 is opened by the cam of the cam line shaft 36, and the coins stacked in the coin stacking section 34 are supported by the coin introducing body 37. Then, the coin introducing body 37 is moved downward by the cam line shaft 36 so as to allow the coin introducing body 37 to introduce the stack of coins to the packaging section 38. In this operation, the packaging rollers 39 sandwich the stack of coins with the aid of the cam of the cam line shaft 36. Since at least one of the packaging rollers 39 is rotated by the motor 55, the stack of coins is rotated.

As in the case when the stack of coins is sandwiched by the packaging rollers 39, the roller 46 is rotated through the clutch 56 by the motor 55 so as to feed the wrapping paper 42 which is held between the rollers 46 and 47, the wrapping paper 42 is clamped and wrapped around the stack of coins by the packaging rollers 39. Furthermore, while the paper 42 is being wrapped around the stack of coins, it is abutted against the cutter 48 so as to be cut off to a predetermined length. In this case, the coin introducing body 37 is displaced from its position below the packaging section 38 to its position beside the same 38.

When the wrapping paper 42 is pulled by the packaging rollers 39, the switch 57 is actuated by the cam of the cam line shaft 36, so that the rotation of the paper feeding roller 46 is stopped with the aid of the electromagnetic clutch 56, thereby suspending the feeding of the wrapping paper 42.

After the paper 42 has been wrapped around the stack of coins, the crimping hooks 49 are placed respectively above and below the stack of coins by the cam of the cam line shaft 36, thus inwardly folding both lateral edge portions of the paper 42. Thus, the packaging of the stack of coins is completed. Thereafter, the crimping hooks 49 are moved away from the packaged stack of coins by means of the cam of the cam line shaft 36. Next, the packaged stack of coins is disengaged from the packaging rollers 39 by the cam of the cam line shaft 36, as a result of which it is allowed to drop into the container 51 through the packaged coin stack receiving section 50. At the same time, the cam line shaft 36 makes one revolution to return to its initial position, thereby to stop the motor 55, and stops itself.

When the stack of coins is introduced to the packaging section 38, the cam line shaft 36 operates to close the shutter mechanism 35. At the same time, the switch 58 is operated by a switching cam (not shown) of the cam line shaft 36, whereby the counting wheel 28 is unlocked, the counter 29 is operated, the motor 31 and the clutch 54 are also operated through the control device 30, and the conveyor 21, the rotary disk 23 and the belt 25*a* are driven.

If it is necessary to operate (drive and stop) the motor 52 and the clutch 53 in synchronization with the motor 31, the motor 52 and the clutch 53 are similarly operated to drive the coin supplying conveyor 11 and the rotary disk 13 to carry out the abovedescribed packaging process.

In the case where all of the coins selected have been delivered to the coin passageway 24 and the number of coins in the coin stacking section 34 is less than the predetermined number, the clear control section 7 is operated. As a result, an electromagnet 58 is operated by the output of the control device 30, so that the shutter mechanism 35 is opened, and the coins left in the coin stacking section 34 are discharged. In this operation, since the cam line shaft 36 remains stopped at its initial position, the following coin packaging operation can be smoothly carried out.

By the operation of either of the clear control section 7 and the stop control section 8, the aforementioned motors 31 and 52 and clutches 54 and 53 are stopped or released, thereby to stop the rotary disks 13 and 23, the conveyor 21, and the belt 25*a*.

On the other hand, the shutter plate 18*a* of the sorted coin containing section 17 which has been opened by the output of the clear control section 7 or the output of the stop control section 8, is closed by the electromagnet 19.

Now, by setting the coin selection control section for the coins of the next largest diameter, similarly as in the above-described coin packaging operation, the width of the coin passageway 24 and the inside diameter of the coin stacking section 34 are adjusted in accordance with the diameter of the coins selected. By the output of the start control section 5, the shutter plate 18*a* of the sorted coin containing section 17 selected is opened by the electromagnet 19, and the conveyor 21, the rotary disk 23, and the belt 25*a* are driven to perform the coin packaging operation.

Thus, the coins in the sorted coin containing sections 17 are packaged succeedingly and separately according to the denominations by operating the coin selection control section 6.

In the case when troubles such as coin jamming in the coin passageway 24 and unsatisfactory paper feeding are caused, the control device 30 is actuated by the operation of a trouble detecting section 59 so as to stop the entire machine. By operating the trouble removal control section after removal of the trouble, the machine is operated again starting from its state where the trouble occurred.

If packaging is not required, coins may be only counted by operating the count selection control section 4. The counted coins are put in a bag or the like provided at the exit end of the coin passageway.

In the machine described above, the counted coins are stacked in the coin stacking section 34 and are introduced into the coin packaging section 38. However, it may be possible that the coins are introduced directly to the packaging section 38 from the coin passageway 24, and when the coins are stacked to the predetermined number, the coins thus stacked are packaged.

In the above-described embodiment, adjustment of the various mechanisms is made in compliance with a coin denomination selection. However, the machine may be so designed that the width of the coin passageway 24 and the inside diameter of the coin stacking section 34 are adjusted with a knob provided for selecting a kind of wrapping paper. Especially in the case where two numbers of pieces are provided for packaging coins of one denomination, the use of this knob is convenient. In this case, the machine may be so designed that the number of coins to be packaged is set with the knob.

In the above-described embodiment, the coin selection control section 6 is made up of the rotary switch; however, it may be push-button type switches provided respectively for the denominations of coins to be packaged by the machine.

Furthermore, if a coin denomination order specifying circuit is provided, then the coin selection control section 6 can be eliminated. More specifically, in this case, upon operation of the start control section 5 only, the width of the coin passageway 24 and the inside diameter of the coin stacking section 34 are adjusted with the aid of a predetermined coin denomination command signal. By detecting this adjustment, the shutter plate 18*a* of the sorted coin containing section 17 is opened, and then the conveyors 11 and 21, the rotary disks 13 and 23, and the belt 25*a* are driven. In this case, a coin detecting means is provided in the coin passageway 24. When it is detected that the counting wheel 28 is not locked and the trouble detecting section 59 detects no trouble, the coin detecting means detects the fact that the coins are not allowed to flow through the coin passageway continuously for a predetermined time. The detection signal is applied to the aforementioned order specifying circuit to operate the electromagnet 58*a* to reject the coins left in the coin stacking section 34. With the delay time required for the rejection of the coins in the coin stacking section 34, adjustments necessary for the next denomination coins are carried out, and the shutter plate 18*a* is selectively opened and closed. Thus, the packaging operation is carried similarly as in the above-described case. When packaging the coins of the last denomination is completed and the coins left in the coin stacking cylinder are rejected, the machine is stopped in its entirety.

When there is no coin of the last denomination in the machine, or it is unnecessary to package the coins of the last denomination, the clear control section 7 is operated for the following packaging operation.

If the coins of different denominations have different thicknesses, the machine may be so designed that the gap between the rotary disk 23 and a regulating guide plate is adjusted with the aid of output of the coin selection control section 6, and the packaging section, for instance the distance between the crimping hooks 49, is adjusted according to the thickness of a selected coin.

Figure 5:
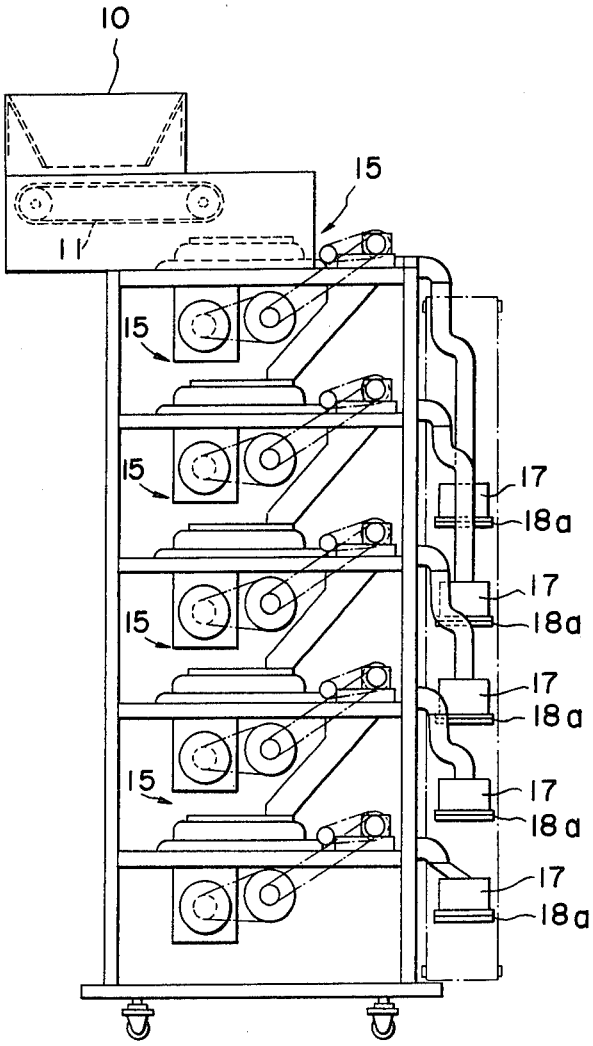
FIG. 5 is a side view of the coin packaging machine shown in FIG. 4.
Figure 7:
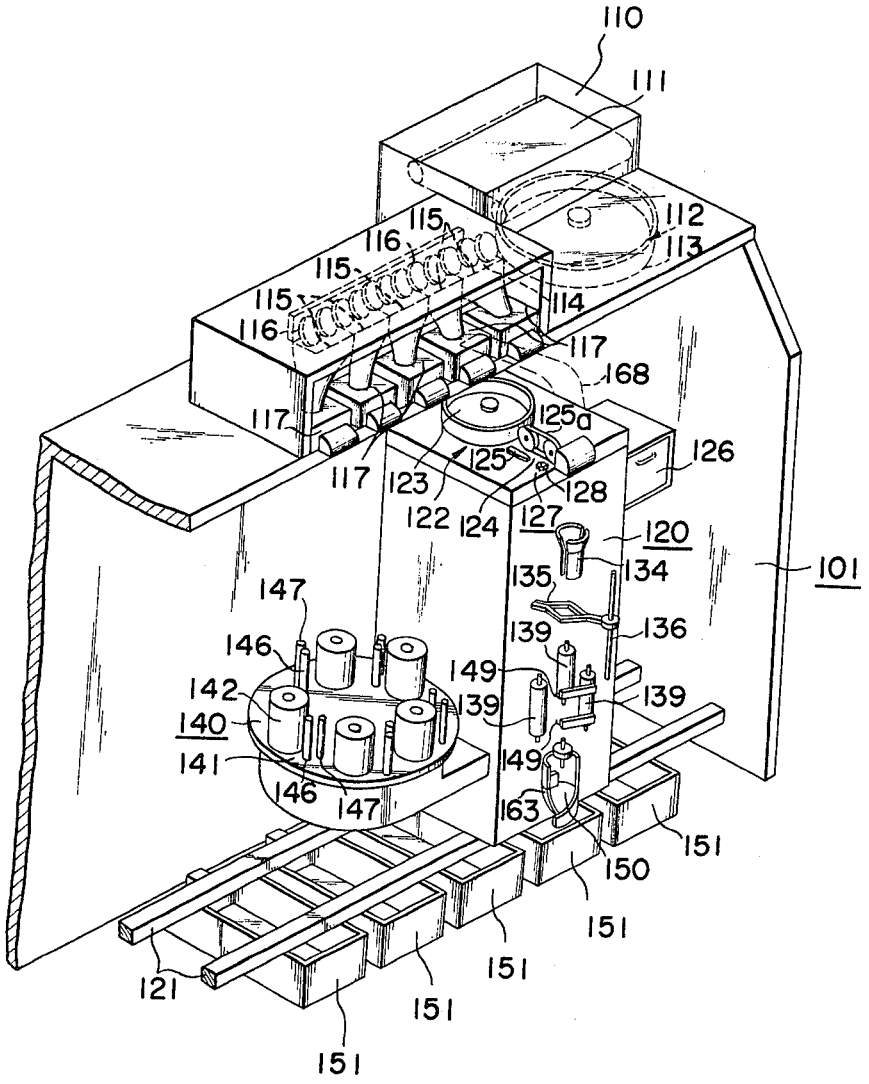
FIG. 7 is a perspective view showing a third embodiment of the coin packaging machine according to the invention.

A second embodiment of this invention is shown in FIGS. 4, 5 and 6.

The second embodiment is different in coin sorting sections 15 from the first embodiment. Each coin sorting section 15 comprises a rotary disk for receiving coins delivered from the coin storing section 10, and a coin sorting passageway for aligning the coins delivered from the rotary disk thereto by centrifugal force and for delivering the aligned coins to the sorted coin containing section 17. The coin sorting sections 15 are vertically arranged in the order of decreasing diameter of coins handled by the machine in such a manner that the section 15 handling the coins of the largest diameter is provided at the top while the section 15 handling the coins of the smallest diameter is at the bottom. Accordingly, from a coin sorting section 15 for sorting out the coins of a certain diameter, the coins whose diameters are smaller than the certain diameter are discharged through a coin sorting passageway onto the rotary disk of another coin sorting section 15 provided immediately below the firstly mentioned section 15.

With the aid of the output of the start control section 5, coins of various denominations are supplied from the coin storing section 10 through the conveyor 11 to the rotary disk of the first coin sorting section 15 which is provided for the largest diameter coins. The coins on the rotary disk are delivered to the coin sorting passageway by the centrifugal force of the rotary disk, where the coins are sorted out and the coins whose diameters are smaller than the largest diameter are discharged onto the rotary disk of the second coin sorting section 15 which is provided immediately below the first coin sorting section 15. Only the coins thus sorted out, that is, the coins of the largest diameter in this case, are delivered into the sorted coin containing section 17. Thus, the coins sorted out by the coin sorting sections 15 are placed in the respective sorted coin containing sections 17.

Similarly as in the first embodiment, the shutter plate 18*a* of the coin introducing mechanism 18 of the sorted coin containing section 17 for the coins selected by operating the coin selection control section 6 is opened, and the coins therein are transferred to the sorted coin delivering mechanism 22 by means of the conveyor 21 in the conveying mechanism 20.

The machine may be so designed that the coins are supplied directly to the rotary disk 23 in the sorted coin delivering mechanism 22, thereby to eliminate the conveyor 21. Furthermore, the conveyor 21 may be replaced by a suitable chute.

A third embodiment of this invention will be described with reference to FIGS. 7 through 10.

Reference numeral 101 designates a coin packaging machine body which comprises an electric source control section 102 for operating switches such as push-button type switches and knob type switches, a start control section 103, a clear control section 104, a stop control section 105, a monitor display section 106, a number-of-packages-coin display section 107, and a coin selection control section 108.

The aforementioned body 101 is provided with a hopper-like coin storing section 110, on the bottom of which there is a coin supplying conveyor 111. At the unloading end of the conveyor 111, there is a coin transferring mechanism 112 which comprises a rotary disk 113 for receiving coins supplied by means of the coin supplying conveyor 111. The coins thus supplied are transferred one after another into a coin sorting passageway 114 by the centrifugal force of the rotary disk 113, being aligned along the passageway 114. Accordingly, the coins are moved on along the passageway 114. This passageway has a plurality of coin sorting sections 115 which serve to sort out the coins according to their diameters. At the exit end of each coin sorting section 115 is provided a sorted coin containing section 117.

The coin sorting sections 115 are so arranged that the coins are sorted out in the order of increasing diameter. A number of roller 116 are provided above the coin sorting passageway 114 so that the coins are moved on being abutted against the passageway 114. More specifically, at least one roller 116 is provided for each coin sorting section 115. The coin sorting section has an opening at the bottom.

Figure 8:
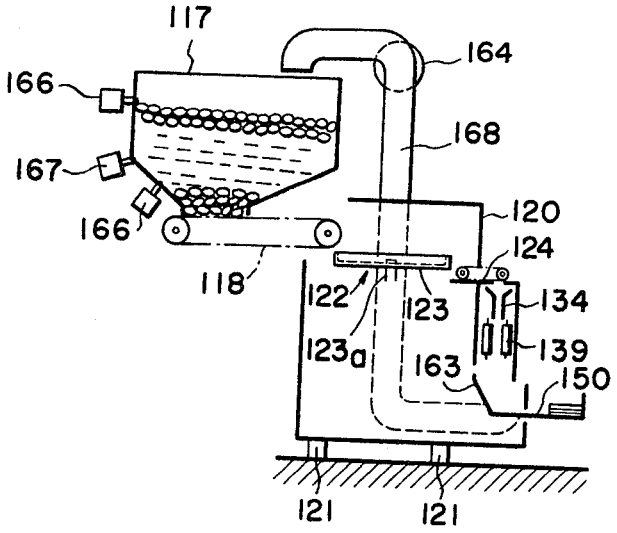
FIG. 8 is an explanatory side view of the coin packaging machine shown in FIG. 7.
Figure 9:
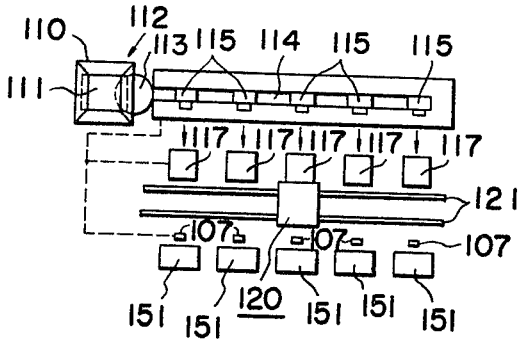
FIG. 9 is an explanatory plan view of the coin packaging machine shown in FIG. 7.
Figure 10A:
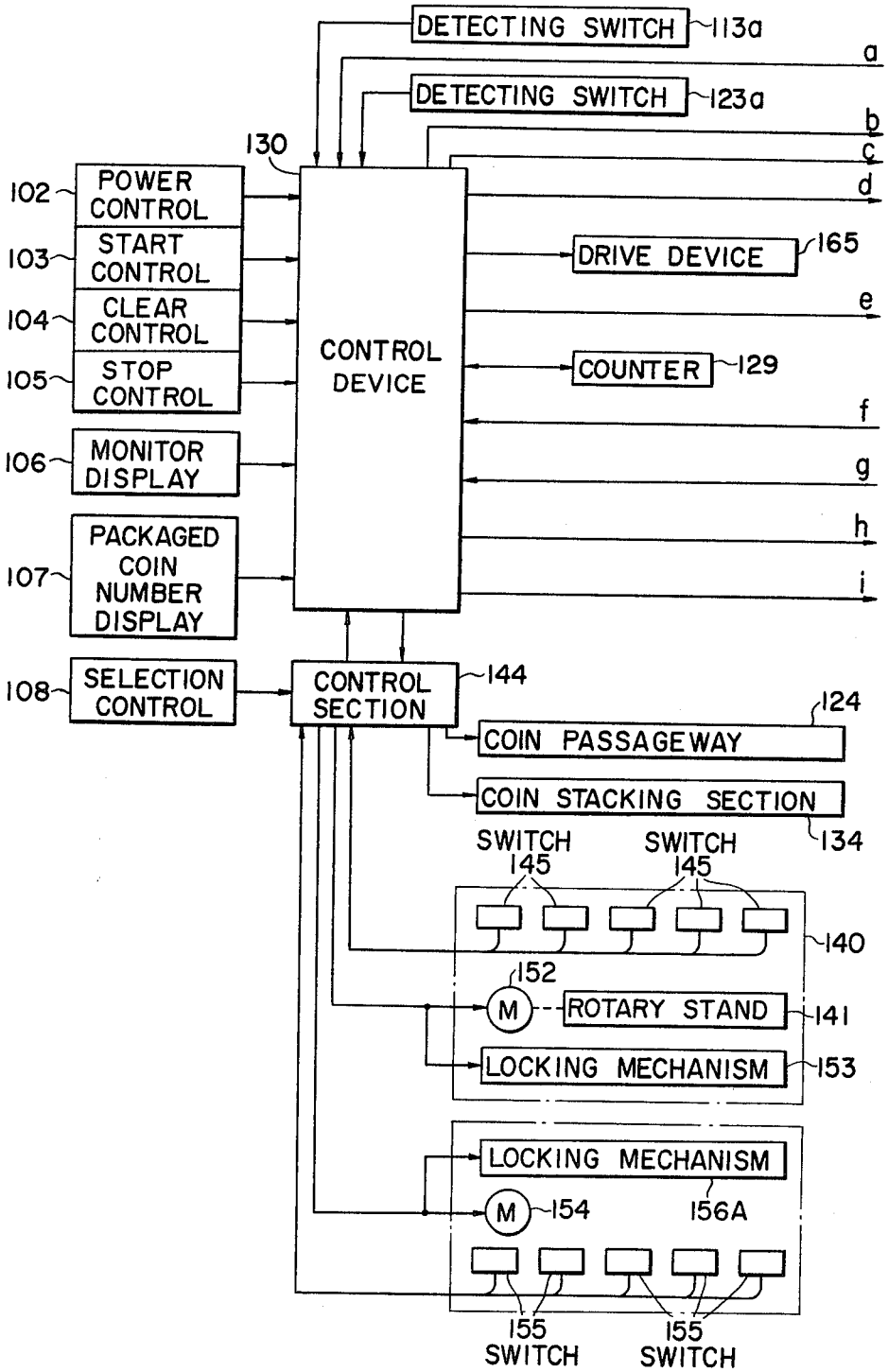
FIGS. 10A and 10B are two parts of a block diagram illustrating an arrangement of the coin packaging machine shown in FIG. 7.
Figure 10B:
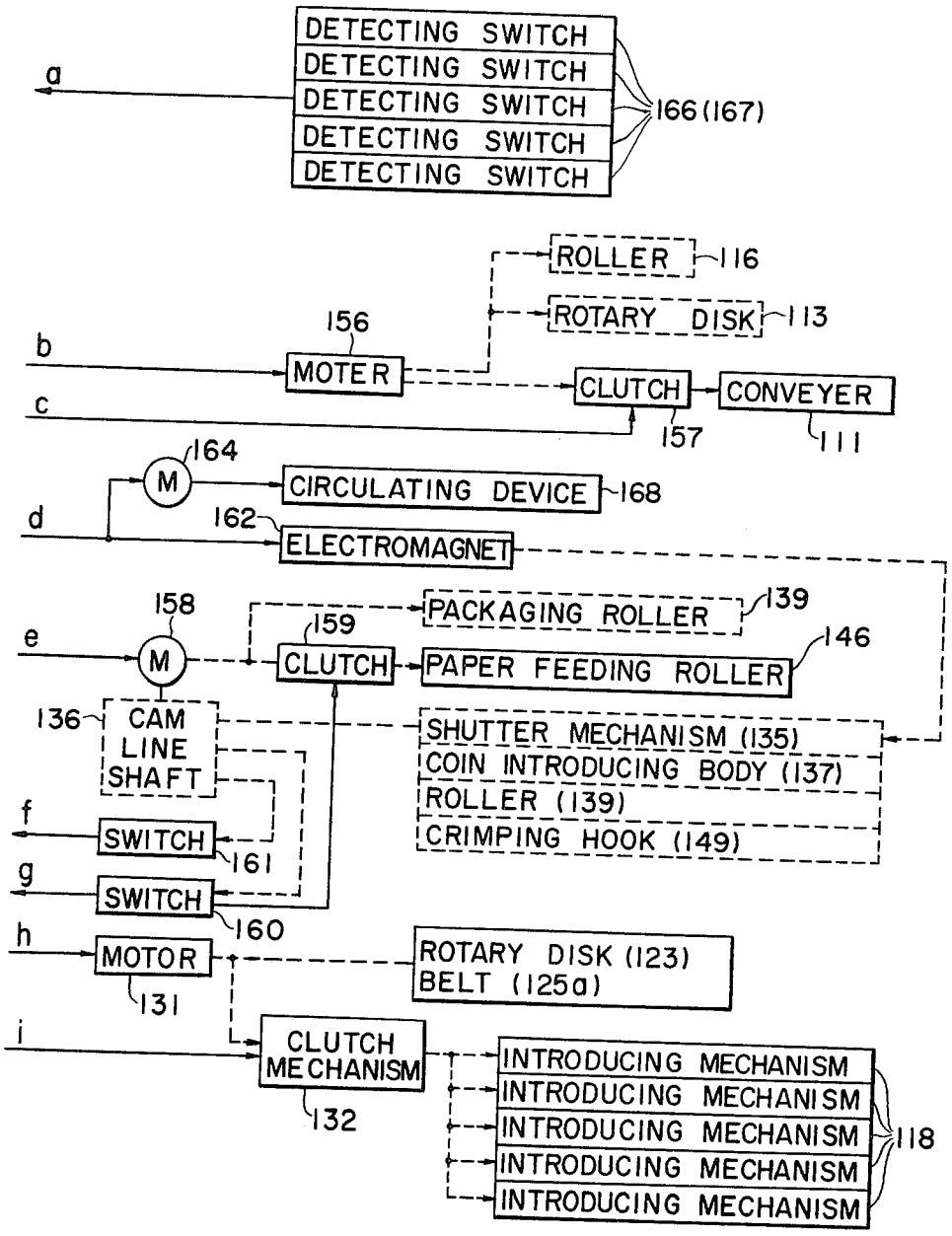

Below the lower opening of each sorted coin containing section 117 is provided a coin introducing mechanism 118 which is selectively operated, as shown in FIG. 8. This mechanism 118 is made up of a conveyer provided below the lower opening of each sorted coin containing section 117.

Reference numeral 120 is intended to designate a coin packaging machine frame which is movable along and below the sorted coin containing sections 117. More specifically, the frame 120 is moved along guide rails 121 provided under the coin packaging machine body 101. A sorted coin delivering mechanism 122 is provided on top of the frame 120, which operates to deliver one by one the coins which are selectively introduced thereto from the coin introducing mechanisms 118 of the sorted coin containing sections 117. This mechanism 122 is made up of a rotary disk 123. Coins fed onto this rotary disk 123 are delivered one by one to a coin passageway 124 by the centrifugal force of the rotary disk 123. The coin passageway 124 is defined by two parallel guide members 125 at least one of which is movable. The distance between the two guide member 125 is adjusted according to the diameter of the coins which has been selected by a cam operated in response to the operation of the aforementioned coin selection control section 108, so that the coins whose diameter is smaller than the selected diameter are rejected through a rejection groove between the guide members 125 and are introduced through a chute into a drawer-like coin holding section 126 which is provided on the frame. Furthermore, a belt **125*a* is provided above the coin passageway 124 in such a manner that the coins fed into the coin passageway 124** are moved on therealong.

Reference numeral 127 designates a coin counting means made up of a counting wheel 128 which is turned through a predetermined angle whenever a coin passes therethrough. The rotation angle of the counting wheel 28 is mechanically or electrically detected to allow a counter 129 to count the number of coins passed therethrough when a predetermined number of coins are counted by the counter 129, the counting wheel 128 is stopped to temporarily prevent the flow of coins. A signal representative of the fact that the predetermine number of coins have been counted is applied from the counter 129 to a control device 130, which in turn produces a stop signal to stop an electric motor 30. As a result, the rotary disk 123 in the sorted coin delivering mechanism 131, and the belt **125*a* of the coin passageway 124 are stopped, while the coin introducing mechanism 118 is stopped which is operated by an electric motor 131 through an electromagnetic clutch mechanism 132**.

The counted coins are introduced from the coin passageway 124 to a coin stacking section 134 where they are stacked one on another. The coin stacking section 134 is made up of a stacking cylinder whose diameter can be adjusted to the diameter of coins selected by the aforementioned coin selection control section 108. Provided at the lower opening of the coin stacking section is a shutter mechanism 135 which is opened and closed by a cam of a cam line shaft 136.

Reference numeral 137 designates a coin introducing body which is operated by a cam of the cam line shaft 136 so as to introduce the coins stacked, or a stack of coins, in the coin stacking section 134 to a packaging section 138.

This packaging section 138 comprises a plurality of rollers 139 which when the stack of coins is brought thereto, operates to sandwich and rotate it. More specifically, at least one of the rollers 139 is moved by a cam of the cam line shift 136 so that the stack of coins is sandwiched (or clamped) by the plurality of rollers 139.

A wrapping paper selection mechanism 140 comprises a rotary stand 141, and rolls of wrapping paper 142 provided respectively for coins of different diameters (or denominations), the rolls being provided on the rotary stand 141. The rotary stand 141 is turned to a predetermined position by the output of a control section 144 which carries out its control operation with the aid of a rotary switch (not shown) operated by the above-described coin selection control section 108. In other words, a position detecting switch 145 is selectively operated by the output of the control section 144, so that the rotary stand 141 is to a feeding position where a wrapping paper 142 is fed for the coins selected. A pair of feeding rollers 146 and 147 are provided on the rotary stand 141 so as to feed the respective wrapping paper 142. A cutter (not shown) is provided in the vicinity of the feeding rollers 146 and 147.

Reference numerals 149 and 149 are intended to designate crimping hooks for folding both lateral edge portions of the paper 142 wrapped around a stack of coins. These hooks 149 are operated by the above-described cam line shaft 136.

A packaged coin receiving section 150 is provided below the packaging section 138. The packaged stacks of coins received by the section 150 are placed selectively in packaged coin containers 151 which are detachably provided below the body 101 in correspondence to the sorted coin containing sections 117.

Further, provided are detecting switches **113*a* and 113*b* which detect the coins on the rotary disk 113 in the coin transferring mechanism 112 and the coins on the rotary disk 123 in the sorted coin delivering mechanism 122**, respectively.

The package coin receiving section 150 is provided with a control board 163, which is operated by a driving device 165 such as an electromagnet so that when coins not packaged are discharged out of the coin stacking section 134, it operates to deliver the coins to a circulating device 168 such as a belt instead of the packaged coin containers 151. The circulating device 168 operates to allow the coins to return to their own sorted coin container 117.

A number-of-coins detecting switch 166 for control and a number-of-coins detecting switch 167 for display are provided for each sorted coin containing section 117. When each switch 166 detects the fact that the number of coins is less than a predetermined value or that during the packaging process the number of coins is reduced, that is, the numbers of coins in all of the sorted coin containing sections 117 are reduced, an electric motor 156 is driven by means of the control device 130. As a result, the coins in the coin storing section 110 are sorted out by operating the coin supplying conveyer 111, the rotary disk 113, and the rollers 116, and are supplied into the respective sorted coin containing sections 117.

When one of the switches 166 detects the fact that the respective sorted coin containing section 117 is full of coins, the motor 156 is stopped to suspend the supply of coins from the coin storing section 110.

The operations of the switches 166 cause the monitor display section 106 to display a sorted coin containing section 117 which is full of coin. In this case, the packaging of the coins in this section 117 is to be carried out.

The number-of-coins detecting switch 167 for display causes the monitor display section 106 to display the number of coins which is necessary for one package of coins for every sorted coin containing section 117. The numbers of the packaged stacks of coins are displayed by the number-of-packaged-coins display section 107 separately according to the denominations.

On a control panel board (not shown) are provided the aforementioned monitor display section 106, number-of-packaged coins display section 107, and control sections 102, 103, 104 and 105, and lamps for displaying denominations selected by the coin selection control section 108.

The operation of the third embodiment thus organized will be described.

The electric source control section 102 is actuated, and the coin selection control section 108 is operated to set the machine to a desired coin denomination, for instance coins of the largest diameter. Upon operation of the control section 108, the movable guide member 125 is moved, and the coin passageway 124 and the coin stacking section 134 are set according to the diameter of the selected coins, and furthermore the position detecting switch 145 is selected by the output of the control section 144, while the motor 152 is driven to rotate the rotary stand 141. When the roll of wrapping paper 142 for the selected coins is set at the paper feeding position, with the aid of the position detecting switch 145 the control section 144 operates to stop the motor 152 and to actuate an electromagnetic locking mechanism 153 adapted to lock the rotary stand 152.

Furthermore, upon operation of the coin selection control section 108, the motor 154 is driven by the output of the control section 144 to move the coin packaging machine frame 120. By this movement of the frame 120 the position detecting switch 144 for the selected coins is operated, as a result of which the control section 144 is operated to stop the motor 154 and accordingly the frame 120. At the same time, an electromagnetic locking mechanism is operated to fixedly secure the frame 120 in such a manner that the sorted coin delivering mechanism 122 is set below the sorted coins containing section 117 of the selected coins so as to supply the selected coins to the mechanism 122, and that the coin receiving section 150 is placed above the container 151 of the selected coins.

Then, a number of coins of various denominations are loaded in the coin storing section 110.

Thereafter, the start control section 103 is operated. If, in this case, both a detection signal from the wrapping paper selecting mechanism 140 which is representative of the fact that the necessary wrapping paper 142 is set at the paper feeding position, and a signal from the control section 144 which is produced with the aid of a detection signal representative of the fact that the frame 120 is set suitably for the selected coins, are applied to the control device 130, then this control device 130 drives the motors 131 and 156. As a result, the rotary disk 113 and the rollers 116 are rotated, while the electromagnetic clutch 157 is operated. The coin supplying conveyer 111 is driven by the motor 156, whereby the coins in the coin storing section 110 are fed to the rotary disk 113. The coins on the rotary disk 113 are delivered one by one to the coin sorting passageway 114 by the centrifugal force of the disk 113, and are moved, in an alignment state, along the passageway 114. The coins are sorted out by the coin sorting sections 115 according to the diameters thereof, and the coins thus sorted out are placed in the respective sorted coin containing sections 117.

The coin introducing mechanism 118 of the sorted coin containing section 117 for the selected coins is driven through the clutch mechanism 132 by the motor 132 with the aid of the output of the control device 130.

On the other hand, the rotary disk 123 and the conveying belt **125*a* on the frame 120 are operated by the motor 131 which is driven by the output signal of the control device. Therefore, the selected coins are supplied to the rotary disk 123 from the sorted coin containing section 117 by the coin introducing mechanism 118. The coins on the rotary disk 123 are delivered one by one to the coin passageway 124 by the centrifugal force of the rotary disk and are further delivered out by the belt 125*a*. In this operation, the coins whose diameters are smaller than the diameter of the selected coins are removed from the coin passageway 124 and are sent to the coin holding section 126 through a chute (not shown). The coins passed through the coin passageway 124, each turning the counting wheel 128 through the predetermined angle, are delivered into the coin stacking section 134 where they are stacked one on another on the shutter mechanism 135. When a predetermined number of coins is detected from the rotation of the counting wheel 128, the counter 129 is operated to lock the counting wheel to stop the flow of coins and to stop the motor 131. As a result, the rotary disk 123, the coin conveying belt 125*a* are stopped, and the coin introducing mechanism 118** is also stopped.

With the aid of the output of the counter 129, the control device 136 drives the motor 158, whereby the cam line shaft 136 is driven. The coin introducing body 137 is placed below the shutter mechanism 135 by the cam of the cam line shaft 136 thus driven. Then, the shutter mechanism 135 is opened by the cam of the cam line shaft 136, as a result of which the coins stacked in the coin stacking section 134 are supported by the coin introducing body 137. Then, the coin introducing body 137 is lowered by means of the cam line shaft 136, and are introduced to the coin packaging section 138 by the coin introducing body 137. In this operation, the packaging rollers 139 sandwich the stack of coins with the aid of the cam of the cam line shaft 136. Since at least one of the packaging rollers 139 is rotated by the motor 158, the stack of coins is rotated.

As in the case when the stack of coins is sandwiched by the packaging rollers 139, the roller 146 is rotated through the clutch 156 by the motor 155 so as to feed the wrapping paper 142 which is held between the rollers 146 and 147, the wrapping paper 142 is clamped and wrapped around the stack of coins by the packaging rollers 139. Furthermore, while the paper 142 is being wrapped around the stack of coins, it is abutted against a cutter (not shown) so as to be cut off to a predetermined length. In this case, the coin introducing body 137 is displaced from its position below the packaging section 138 to its position beside the same 138.

When the wrapping paper 142 is pulled by the packaging rollers 139, the switch 160 is actuated by the cam of the cam line shaft 136, so that the rotation of the paper feeding roller 146 is stopped with the aid of the electromagnetic clutch 159, thereby suspending the feeding of the wrapping paper 142.

After the paper 142 has been wrapped around the stack of coins, the crimping hooks 149 are placed respectively above and below the stack of coins by the cam of the cam line shaft 136, thus inwardly folding both lateral edge portions of the paper 142. Thus, the packaging of the stack of coins is completed. Thereafter, the crimping hooks 149 are moved away from the packaged stack of coins by means of the cam of the cam line shaft 136. Next, the packaged stack of coins is disengaged from the packaging rollers 139 by the cam of the cam line shaft 136, as a result of which it is allowed to drop into the container 151 through the section 150. At the same time, the cam lines make one revolution to return its initial position, thereby to stop the motor 158, and stops itself.

When the stack of coins is introduced to the packaging section 138, the cam line shaft 136 operates to close the shutter mechanism 135. At the same time, the switch 161 is operated by a switching cam (not shown) of the cam line shaft 136, whereby the counting wheel 128 is unlocked, the counter 129 is operated, the motor 131 and the clutch 132 are also operated through the control device 130, and the conveyer 121, the rotary disk 123 and the belt **125*a*** are driven, so as to repeat the abovedescribed coin packaging operation.

In the case where all of the coins selected have been delivered to the coin passageway 124 and the number of coins in the coin stacking section 134 is less than the predetermined number the clear control section 104 is operated. As a result, an electromagnet 162 is operated by the output of the control device 130, so that the shutter mechanism 135 is opened, and the coins left in the coin stacking section 134 are discharged. In this operation, since the cam line shaft 136 remains stopped at its initial position, the following coin packaging operation can be carried out smoothly.

When, as was described before, a denomination of coins to be packaged is selected by operating the coin selection control section 108, by the operation of the control section 144 the packaging frame 120 is set at a position corresponding to the denomination of coins thus selected, and a wrapping paper 142 for the coin denomination selected is set at the paper feeding position by the wrapping paper selecting mechanism. A position signal produced by the packaging frame and a paper selection signal produced by the wrapping paper selecting mechanism 140 are applied from the control section 144 to the control device 130.

When the rotary disk 123 of the sorted coin delivering mechanism 122 is not full of the selected coins, it is detected by a detecting switch **123*a*, the detection signal of which is applied to the control device 130. With the aid of the position signal from the packaging frame 120, the paper selection signal from the paper selecting mechanism 140, and the detection signal from the detecting switch 123*a*, the control device 130 operates the electromagnetic clutch mechanism 132, the coin introducing mechanism 118 for the selected coin denomination is operated, and the coins in the sorted coin containing section 117 are supplied to the sorted coin delivering mechanism 122**.

The electromagnetic clutch 132 is of a two-stage clutch mechanism. The first stage of the clutch 132 is operated by the position signal from the packaging frame 120 and the paper selection signal from the paper selecting mechanism 140, and the second stage thereof is operated by the detection signal from the detecting switch **123*a*. One of the first and second stages operates to select a coin introducing mechanism according to the selected coin denomination. When the rotary disk 123 is full of the coins, the electromagnetic clutch 132 is released by the operation of the detecting switch 123, and the coin introducing mechanism 118** is stopped.

When the rotary disk 103 in the sorted coin delivering mechanism 112 is full of the coins, the electromagnetic clutch 157 is released by the operation of the detecting switch **113*a*, and the coin supplying conveyer 111** is stopped.

Upon operation of the clear control section 104, the control board 163 of the coin receiving section 150 is operated by a driving device 165 such as an electromagnet so that the coins discharged from the coin stacking section because the number of the coins is less than the predetermined number of pieces, are sent to the circulating device 168 of the packaging frame 120 instead of the packaged coin container 151. In this case, the clear control section 104 is operated so that an electric motor 164 is driven by the output of the control device 130 for a predetermined period of time, whereby the coins sent to the circulating device 168 are returned to the respective sorted coin containing section 117.

In this operation, the coin introducing mechanism 118, the rotary disk 123, the coin conveying belt **125*a*, and the rollers 116 are stopped by the aforementioned operation of the clear control section 104**.

Now, if the coin selection control section 108 is set for the coins of the second largest diameter for instance, similarly as in the above-described coin packaging operation, the width of the coin passageway 124 and the inside diameter of the coin stacking section 134 are adjusted in accordance with the diameter of the coins selected. The paper selecting mechanism 140 is operated by driving the motor 152 so that the wrapping paper 142 for the selected coins is set at the paper feeding position. On the other hand, the packaging frame 120 is set by the motor 154 as was described before, and the sorted coin delivering mechanism 122 is placed below the sorted coin containing section 117 for the selected coins. By the output of the start control section 103 the coin introducing mechanism 118 for the sorted coin containing section 117 is operated, and the rotary disk 123 and the conveying belt **125*a*** are driven. Thus, the above-described coin packaging operation is carried out.

Similarly, the coins in the sorted coin containing sections 17 are packaged succeedingly and separately according to the denominations by operating the coin selection control section 108.

When all of the sorted coin containing section 117 are short of the respective coins, the motor 156 is driven by the operation of the number-of-coins detecting switches 166. Thus, the coins in the coin storing section 110 are transferred to the coin sorting passageway 114 where they are sorted out and are supplied into the respective sorted coin containing sections 117. When any one of the sections 117 becomes full of the coins, the motor 156 is stopped and the supply of coins is suspended.

Figure 11:
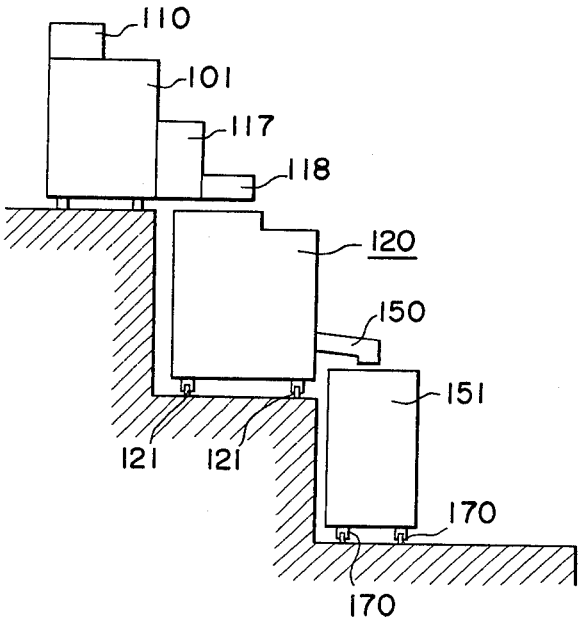
FIG. 11 is an explanatory diagram showing a fourth embodiment of the coin packaging machine according to the invention.

The machine may be so designed that, as shown in FIG. 11, the packaging frame 120 is movably provided below an assembly comprising the coin storing section 110, the coin delivering mechanism 112, the coin sorting passage 114 and the sorted coin containing sections 117 so that the coins are supplied to the rotary disk 123 on the frame 120 from the coin introducing mechanism 118 of each sorted coin containing section 117, and that the packaged coin containers 151 on a carriage 170 are provided below the packaging frame 120.

In the above-described machine, the counted coins are stacked in the coin stacking section 134 and are introduced into the coin packaging section 138. However, it may be possible that the coins are introduced one by one directly to the packaging section 138, and when the coins are stacked to the predetermined number, the coins thus stacked are packaged.

In the above-described embodiment, adjustment of the various mechanism is made in compliance with a coin denomination selection. However, the machine may be so designed that the width of the coin passageway 124 and the inside diameter of the coin stacking section 134 are adjusted with a knob provided for selecting a kind of wrapping paper. Especially in the case where two numbers of pieces are provided for packaging coins of one denomination, the use of this knob is convenient. In this case, the machine may be so designed that the number of coins to be packaged is set with the knob.

In the above-described embodiment, the coin selection control section 108 is made up of the rotary switch; however, it may be push-button type switches provided respectively for the denominations of coins to be packaged by the machine.

Furthermore, if a coin denomination order specifying circuit is provided, then the coin selection control section 108 can be eliminated. More specifically, in this case, a predetermined coin denomination command signal is provided by operating the start control section only, so that the width of the coin passageway 124 and the inside diameter of the coin packaging section 134 are adjusted while the packaging frame 120 is suitably set. By detecting the completion of the adjusting and setting operations, the coin delivering mechanism 112, the rollers 116, the coin introducing mechanism 118 of the sorted coin containing section 117 for the selected coins, the rotary disk 123, and the belt **125*a* can be operated. In this case, a coin detecting means is provided in the coin passage 124. More specifically, when it is detected tha the counting wheel is unlocked, the coin detecting means detects the fact that the flow of coins is not continued in the coin passageway 124 for a predetermined period of time, and the detection signal of the coin detecting means is applied to an order specifying circuit, so that the electromagnet 162 is operated to remove the coins in the coin stacking section 134. All of the necessary adjustments for the next denomination of coins predetermined are carried out with a delay time required for the removal of the coins from the coin stacking section 134, and the coin introducing mechanism 118 of the sorted coin containing section 117** for the selected coins is operated. Then, the coin packaging operation is carried out similarly as described before. When the coins of the last denomination have been packaged, and the coins left in the coin packaging section have been removed, the machine is stopped in its entirety.

In this connection, when there is no coin of the last denomination or it is unnecessary to package the coins of the last denomination, the clear control section 104 is operated for the following packaging operation.

As is apparent from the above description, according to this invention, even if coins of different denominations are mixedly supplied to the machine, the coins are sorted out, counted, and packaged separately according to the denominations. Accordingly, it is unnecessary to sort out the coins before they are supplied to the machine, which leads to an efficient coin packaging operation. In addition, sorting out coins and packaging coins of any one denomination can be carried out at the same time, and therefore the period of time required for packaging coins can be reduced greatly.

As the coins sorted out according to the denominations are temporarily stored separately in the sorted coin delivering mechanism, the order of packaging the coins is independent of the diameters, or denominations, that is, it is possible to start the coin packaging operation from any denomination.

We claim:

1. A coin packaging system comprising:

(a) a coin sorting section for sorting out coins of plural denominations according to the denominations;

(b) a coin packaging section for packaging coins of a denomination selected out of the coins thus sorted out, for every predetermined number of pieces thereof; and (c) a coin selecting means for selecting a denomination of coins to be packaged out of the coins sorted out by said coin sorting section, so that said coin packaging section operates to package the coins sorted out according to the denominations, on the basis of a denomination selected.

2. A coin packaging system comprising:

(a) a coin sorting section for sorting out coins of plural denominations according to the denominations;

(b) sorted coin containing sections for containing the coins sorted out by said coin sorting section, separately according to the denominations;

(c) a coin selecting section for selecting a denomination of coins to be packaged out of the coins contained in said sorted coin containing section separately according to the denominations;

(d) a coin packaging section for packaging coins of a denomination selected by said coin selecting section, for every predetermined number of pieces thereof; and (e) a sorted coin delivering means for delivering to said coin packaging section sorted coins of a denomination selected by said coin selecting section, so that the coins sorted out according to the denominations are conveyed to and packaged by said coin packaging section succeedingly in the order of denominations selected by said coin selecting section.

3. A coin packaging system comprising:

(a) a coin sorting section for sorting out coins of plural denominations according to the denominations;

(b) sorted coin containing sections for containing the coins sorted out by said coin sorting section, separately according to the denominations;

(c) a coin selecting section for selecting a denomination of coins to be packaged out of the coins contained in said sorted coin containing section separately according to the denominations;

(d) a coin packaging section for packaging coins of a denomination selected by said coin selecting section, for every predetermined number of pieces thereof; and (e) a moving means which basing on the operation of said coin selecting section, moves said coin packaging section to a selected one of said sorted coin containing sections, so that in response to the selection of a denomination said packaging section is moved to a sorted coin containing section which contains coins of the denomination selected whereby the coins in the sorted coin containing sections are successively packaged separately according to the denominations.

* * * * *